US006355141B1

(12) United States Patent
Sikkar et al.

(10) Patent No.: US 6,355,141 B1
(45) Date of Patent: Mar. 12, 2002

(54) PROCESS FOR THE PRODUCTION OF PAPER

(75) Inventors: Rein Sikkar, Floda; Michael Persson, Göteborg; Maria Norell, Hovås, all of (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 09/298,594

(22) Filed: Apr. 23, 1999

Related U.S. Application Data

(60) Provisional application No. 60/082,784, filed on Apr. 23, 1998.

(30) Foreign Application Priority Data

Apr. 23, 1998 (EP) ..... 98850061

(51) Int. Cl.[7] ..... D21H 21/10

(52) U.S. Cl. ..... 162/181.9; 162/164.3; 162/164.6; 162/168.1; 162/168.2; 162/168.3; 162/175; 162/183

(58) Field of Search ..... 162/181.9, 183, 162/158, 168.1, 175, 168.2, 168.3, 164.3, 164.6

(56) References Cited

U.S. PATENT DOCUMENTS 5,367,051 A 11/1994 Narang et al. ..... 528/424

FOREIGN PATENT DOCUMENTS

| | | | |
|---|---|---|---|
| EP | 0 041 056 | 12/1981 | ..... D21D/3/00 |
| EP | 0 534 656 | 3/1993 | ..... D21H/23/14 |
| EP | 0 540 311 | 5/1993 | ..... C01B/31/00 |
| WO | WO 97/30220 | 8/1997 | ..... D21H/17/67 |

OTHER PUBLICATIONS

Colloids and Surfaces, Preparation of hollow carbon–microbeads from water–in–oil emulsion using amphiphilic carbonaceous material, Kunio Esumi, et al. 108(1996), pp. 113–116.

J. Chem. Soc., Chem. Commun, $C_{60}$ Fullerol Formation catalysed by Quaternary Ammonium Hydroxides, Jing Li, et al., (1993), pp. 1784–1785.

The Chemistry of the Fullerenes, A. Hirsch, (1994) pp. 64–65.

*Primary Examiner*—Peter Chin
(74) *Attorney, Agent, or Firm*—Lainie E. Parker

(57) ABSTRACT

A process for the production of paper in which cellulosic fibers are treated with microparticles comprising shell-formed carbon allotrope particles, paper obtainable from this process, and a drainage and/or retention agent comprising at least partially hydrophilic, anionic microparticles comprising shell-formed carbon allotrope particles.

14 Claims, No Drawings

PROCESS FOR THE PRODUCTION OF PAPER

The present case claims priority of U.S. provisional application Ser. no. 60/082,784, filed Apr. 23, 1998 and of European Patent Application No. 98850061.7, filed on Apr. 23, 1998.

FIELD OF THE INVENTION

The present invention relates to a paper production process. In the present application the term "paper production process" is intended to encompass the entire paper production process, i.e. from the defibration of the wood until the paper product is ready to be supplied to the market. The present invention also relates to paper obtainable by said process, whereby "paper" is to be understood to include also board, paperboard, fibreboard, and cardboard, as well as any other similar cellulosic fibre containing product. Furthermore, the invention relates to paper making additives such as drainage and retention agents that may be used in such a process.

BACKGROUND OF THE INVENTION

The paper making process usually involves the use of various additives in order to control the paper production process as such and/or the properties of the produced paper. Drainage and retention agents are among the most common paper making additives.

A wide variety of drainage and retention agents are known in the art. These additives are included in the papermaking stock in order to facilitate drainage and/or to increase adsorption of fine particles and additives onto the cellulose fibres so that they are retained with the fibres. The drainage and retention agents employed include natural and synthetic organic polymers, particles of inorganic materials and many combinations thereof. Usually, oppositely charged materials are used. Certain microsize particles, namely colloidal silica particles, in combination with cationic starch, such as for example disclosed in EP-B-41,056 is an example of a commonly used drainage and retention agent. The particles act as flocculants, binding the polymer molecules to larger aggregates.

A common feature of the drainage and retention agents referred to above is that they contain certain microsize particles, below referred to as microparticles. It would be desirable to be able to provide a paper production process in which othermicroparticles than those presently known in the art are used as that would provide, at least ceteris paribus, for a bigger supply of microparticles. In a drainage/retention agent it would be desirable to use microparticles that could provide, at least potentially, for better flocculation. Microparticles that could provide for all of this would of course be especially desirable.

Thus, the problem to be solved by the present invention is to provide a paper production process in which such microparticles are used. This problem has been solved by the present invention as defined by the appended claims.

SUMMARY OF THE INVENTION

The present invention generally relates to a process for the production of paper comprising cellulosic fibers, which comprises treating at least some of the fibers with microparticles, wherein the microparticles comprise shell-formed carbon allotrope particles. The present invention also relates to paper obtainable by said process, whereby "paper" is to be understood to include also board, paperboard, fibreboard, and cardboard, as well as any other similar cellulosic fiber containing product. Furthermore, the invention relates to paper making additives such as drainage and retention agents that may be used in such a process.

DETAILED DESCRIPTION OF THE INVENTION

The present invention relates to a process for the production of paper comprising cellulosic fibers, wherein at least some of the fibers are treated at some part of the process with microparticles comprising shell-formed carbon allotrope particles. It has been found that the particle charge density of these microparticles may greatly influence the effect of the drainage/retention agents. It would seem that microparticles having a high particle charge density provide for a potentially better flocculation in a drainage/retention operation. The reason for this is as follows:

In a drainage/retention operation, a cationic polymer and anionic microparticles form complex agglomerates in the stock, which agglomerates are bound together by the anionic microparticles, and the cationic polymer becomes associated with filler material having a more or less anionic surface. The cationic polymer also becomes associated with the cellulosic fibers and fines, both of which are anionic. Upon bonding, the association between the agglomerates and the cellulosic fibers provides flocculation. It would seem that a higher particle charge density of the anionic microparticles would provide for more anionic groups on the particle surface, in turn providing more bond sites and, as a consequence, potentially bigger agglomerate.

In the present application the term "microparticle" indicates a particle having a particle size of up to about 10 $\mu$m, preferably up to about 100 nm, and most preferably up to about 20 nm.

The microparticles used in the present invention comprise shell-formed carbon allotrope particles, which may mean that each microparticle consists of one or more shellformed carbon allotrope particles, but may just as well mean that themicroparticles are only partly made up of shell-formed carbon allotrope particles whereas the other part is made up of some other substance.

By "shell-formed carbon allotrope" is meant any carbon allotrope in which the atoms are arranged so as to form a shell, preferably a closed shell having an essentially spherical form. An open shell form, such as for instance the form of a tube with one or more openings, is however not excluded.

In a preferred embodiment of the present invention the shell form is defined by the atomic lattice, i.e. each unit of this lattice constitutes an individual shell. An illustrative and preferred example of this embodiment is of course the fullerene allotrope, e.g. a [60] fullerene or a [70]fullerene. It is however not ruled out that the shell-formed particles may be socalled "hollow carbon microbeads" as disclosed by K. Esumi et al in Colloids and Surfaces, A: Physicochem. Eng. Aspects 108 (1996) 113–116, in which the shell form is defined by a plurality of atomic lattice units.

In one embodiment, the shell-formed carbon allotrope comprises one or more heteroatoms, such as for instance a Si, B, N, S, or P atom. In a particular example, the carbon allotrope is a heterofullerene such as described in "The Chemistry of the Fullerenes" by A. Hirsch, (Georg Thime Verlag, Stuttgart, New York 1994, chapter 9.4.2, page 196).

The carbon allotrope particles may be furnished with addends and/or substituents; the particles may for instance be hydroxylated, sulphonated, or carboxylated. For instance, carbon allotrope particles may be polyhydroxylated fullerene derivatives, so-called fullerols, e.g. prepared according to the methods described by Jing Li et al in J. Chem. Soc., Chem. Commun., 1993, pp 1784–5 ("$C_{60}$ Fullerol Formation catalysed by Quartenary Ammonium Hydroxides"), or EP 540 311.

The invention can be used in a variety of flocculation operations, including for instance sludge dewatering, waste water treatment, wine clarification; this listing of flocculation operations is of course not exhaustive.

In one embodiment the particles are used for the purpose of improving the dewatering/retention performance of a paper making process, whereby the microparticles are preferably combined with a polymer. The particles and the polymer are added, either mixed or separated from each other, either simultaneously or consecutively, to the papermaking stock, whereby the shell-formed carbon allotrope particles are at least partially hydrophilic, and preferably soluble in aqueous solutions. In this embodiment the carbon allotrope is preferably an anionic fullerene derivative, e.g. a hydroxylated, sulphonated, or carboxylated fullerene derivative. When used for dewatering/retention performance improvement, the carbon allotrope particles are preferably associated with each other, e.g. by means of covalent bonds, electrostatic bonds, ionic bonds, or any similar kind of bonds. The bonds may for instance be constituted by means of one or more hydrocarbyl groups and/or one or more atoms chosen among N, O, P, S, B, and Si. Said atoms may form an integrated part of the particles or be comprised in an addend or substituent to the particles, but may also form a bridge between addends or substituents of two or more allotrope particles. The hydrocarbyl group may be an addend or substituent common to two or more allotrope particles, but may also form a bridge between addends or substituents of two or more allotrope particles, for instance between atoms chosen among N, O, P, S, B, and Si. The concept of fullerene polymers is discussed in "The Chemistry of the Fullerenes" by A. Hirsch, (Georg Thime Verlag, Stuttgart, New York 1994, chapter 3.2.3, page 64–65), and one way to prepare such fullerene polymers is for instance disclosed in U.S. Pat. No. 5,367,051.

The allotrope microparticles may for instance be combined with a polymer having a branched or unbranched hydrocarbon chain, with or without substituents; it may for instance be chosen among starches, chitosans, seed gums such as guar gums, acrylamide-based polymers, poly (diallyidimethyl ammonium chloride), polyethylene imines, polyamines, polyamidoamines, melamine-formaldehyde resins, urea-formaldehyde resins, N-vinylamidebased polymers, or a combination thereof. In one preferred embodiment the polymer has a branched hydrocarbon chain.

Preferably, when used for dewatering/retention purposes, the allotrope microparticles are present in the papermaking stock in an amount of at least 0.005 kg/tonne of pulp, particularly preferred in an amount from about 0.03 to 5 kg/ton of pulp. The unit kg/ton is calculated as dry on dry fibres and optional fillers, and by a "ton" is meant a metric ton.

The present invention also relates to paper obtainable from this dewatering/retention performance improved paper making process.

Furthermore, the present invention relates to a drainage or retention agent comprising at least partially hydrophilic, anionic microparticles comprising shell-formed carbon allotrope particles, which is adapted to be used in said dewatering/retention performance improved paper making process. The partially hydrophilic, anionic microparticles are at least partially made up of carbon allotrope particles that are associated with each other, e.g. by means of covalent bonds, electrostatic bonds, ionic bonds, or any similar kind of bonds. The bonds may for instance be constituted by means of one or morehydrocarbyl groups and/or one or more atoms chosen among N, O, P, S, B, and Si. Said atoms may form an integrated part of the particles or be comprised in an addend or substituent to the particles, but may also form a bridge between addends or substituents of two or more allotrope particles. The hydrocarbyl group may be an addend or substituent common to two or more allotrope particles, but may also form a bridge between addends or substituents of two or more allotrope particles, for instance between atoms chosen among N, O, P, S, B, and Si.

The present invention will now be illustrated by means of some non-limiting examples.

EXAMPLES

Example 1

Polyhydroxylated fullerene derivatives, so-called fullerols, were prepared essentially according to the method described by Jing Li et al in J. Chem. Soc., Chem. Commun., 1993, pp 1784–5 ("$C_{60}$ Fullerol Formation catalysed by Quartenary Ammonium Hydroxides"). More particularly, two kinds of fullerols, fullerol A and fullerol B, were produced:

Fullerol A and B were produced according to the following procedure: C-60 Fullerene was mixed with 1,7-diaminoheptane ( molar ratio of 2:1) in benzene. The reagents were stirred at ambient temperature for 48 hours after which the reaction mixture, consisting of coupled aminofullerenes, was subjected to hydroxylation according to the method described by Jing-Li et al in J. Chem. Soc., Chem. Commun., 1993, pp 1784–5 ("C60 Fullerol Formation catalysed by Quartenary Ammonium Hydroxides"). The watersoluble reaction mixture was precipitated by addition of methanol which yielded Fullerol A as a brownish solid. The mother liquor was evaporated to dryness and the residue again dissolved in water and precipitated by methanol yielding Fullerol B as an almost black solid. The mass yields of Fullerol A and B were about equal. The two fractions were used in the following examples.

Example 2

In the following tests, drainage performance was evaluated by means of a Dynamic Drainage Analyser (DDA), available from Akribi AB, Sundsvall, Sweden, which measures the time required to drain a set volume of stock through a wire when removing a plug and applying a vacuum to the side of the wire opposite the stock.

The drainage tests were made using a stock having a pH of 8.5 and a consistency of 0.3%, which contained 70% cellulosic fibres, 60% bleached hardwood Kraft and 40% bleached softwood Kraft and 30% Hydrocarb 60. The stock further contained 0.3 g/l $Na_2SO_4$*10 $H_2O$ In test 2A microparticles according to the present invention were tested in conjunction with a cationic polymer, Raisamyl 142, which is a conventional medium-high cationised starch having a degree of substitution of 0.042, which was added to the stock in an amount of 12 kg/ton. In test 2B microparticles according to the present invention were tested in conjunction with a cationic polyacrylamide of 10 mole-% cationic charge and a molecular weight of about 6 million Da, which was added to the stock in an amount of 1 kg/ton.

The stock was stirred in a baffled jar at a speed of 1500 rpm throughout the test and chemical additions to the stock were conducted as follows:

i) adding cationic starch or polymer followed by stirring for 30 seconds, ii) adding the microparticles comprising shell-formed carbon allotrope particles, followed by stirring for 15 seconds, iii) draining the stock while automatically recording the drainage time.

Table I shows the drainage results, in seconds, obtained in test 2A when using varying dosages of fullerols A and B;

shorter drainage times means better drainage performance of the fullerols. Without addition of microparticles, the stock had a drainage time of 18 seconds.

TABLE I

| Microparticles | 0.25 kg/ton | 0.5 kg/ton | 0.75 kg/ton | 1.0 kg/ton | 1.5 kg/ton | 2.0 kg/ton | 2.5 kg/ton |
|---|---|---|---|---|---|---|---|
| Fullerol A | 15.9 | 12.8 | 11.5 | 9.78 | 8.57 | 6.79 | 6.7 |
| Fullerol B | 16.2 | 14.6 | 13.5 | 12.2 | 9.41 | 8.87 | 10.5 |

Table II shows the drainage results, in seconds, obtained in test 2B when using varying dosages of fullerols A and B. Without addition of microparticles, the stock had a drainage time of 16.9 seconds.

TABLE II

| Microparticles | 0.1 kg/ton | 0.25 kg/ton | 0.5 kg/ton | 0.75 kg/ton | 1.0 kg/ton | 2.0 kg/ton |
|---|---|---|---|---|---|---|
| Fullerol A | 15.6 | 14.3 | 13.1 | 12.8 | 13.6 | — |
| Fullerol B | 16.2 | 15.4 | 15.2 | 15.3 | 15.1 | 15.7 |

As can be seen in Table I as well as in Table II, themicroparticles according to the invention had a clear effect on the drainage performance.

Example 3

In these test series, retention was evaluated by means of the DDA used in Example 2 in combination with a nephelometer. First pass retention was evaluated by measuring the turbidity of the filtrate, the white water, obtained by draining the stock. Additives and addition order in test 3A were the same as in test 2A, and the conditions pre/ailing in test 3B were also applied in test 2B.

Table III shows the retention effect measured in test 3A as turbidity of white water obtained by dosing varying amounts of fullerols A and B, where dosages are in kg/ton. Without addition of microparticles, the stock had a turbidity of 119 NTU.

TABLE III

| Microparticles | 0.5 kg/ton | 0.75 kg/ton | 1.0 kg/ton | 1.5 kg/ton | 2.0 kg/ton | 2.0 kg/ton |
|---|---|---|---|---|---|---|
| Fullerol A | 97 | 89 | 83 | 72 | 75 | 66 |
| Fullerol B | 106 | 102 | 97 | 73 | 76 | 86 |

Table IV shows the retention effect measured in test 3B asturbidity of white water obtained by dosing varying amounts of fullerols A and B, where dosages are in kg/ton. Without addition of microparticles, the stock had a turbidity of 96 NTU.

TABLE IV

| Microparticles | 0.1 kg/ton | 0.5 kg/ton | 0.75 kg/ton | 1.0 kg/ton | 2.0 kg/ton |
|---|---|---|---|---|---|
| Fullerol A | 94 | 73 | 71 | 78 | — |
| Fullerol B | 92 | 83 | 85 | 88 | 91 |

As can be seen in Table III as well as in Table IV, themicroparticles according to the invention had a clear impact on the retention effect.

We claim:

1. A process for the production of paper from pulp comprising cellulosic fibers, which comprises adding to a papermaking pulp stock a polymer and microparticles, wherein the microparticles comprise shell-formed carbon allotrope particles which are present in the papermaking stock in an amount of at least 0.005 kg/tonne of pulp.

2. The process of claim 1 wherein the carbon allotrope is a fullerene and/or a fullerene derivative.

3. The process of claim 2 wherein the fullerene is a (60)fullerene or a (70)fullerene.

4. The process of claim 1 wherein said shell-formed carbon allotrope comprises at least one heteroatom.

5. The process of claim 1 wherein the carbon allotrope particles are furnished with addends and/or substituents.

6. The process of claim 1 further comprising adding microparticles and a polymer to a papermaking stock, and said shell-formed carbon allotrope particles are at least partially hydrophilic.

7. The process of claim 6 wherein said shell-formed carbon allotrope particles are soluble in aqueous solutions.

8. The process of claim 6 wherein the carbon allotrope is an anionic fullerene derivative.

9. The process of claim 6 wherein the carbon allotrope is a hydroxylated, sulphonated, or carboxylated fullerene derivative.

10. The process of claim 6 wherein two or more of said shell-formed carbon allotrope particles are associated with each other.

11. The process of claim 10 wherein two or more of the shell-formed carbon allotrope particles are associated with each other by means of at least one hydrocarbyl group and/or at least one atom chosen among N, O, P, S, B, and Si.

12. The process of claim 10 wherein the polymer is selected from the group consisting of starches, chitosans, guar gums, acrylamide-based polymers, poly (diallyidimethyl ammonium chloride), polyethylene imines, polyamines, polyamidoamines, melamine-formaldehyde resins, urea-formaldehyde resins, N-vinylamide-based polymers, and mixtures thereof.

13. Paper prepared in accordance with the process of claim 1.

14. The process of claim 1 wherein the cellulosic fibers form part of a pulp from which the paper is produced and the amount of microparticles used to treat the cellulosic fiber is at least 0.005 kg/ton pulp.

* * * * *

UNITED STATES PATENT AND TRADEMARK OFFICE

CERTIFICATE OF CORRECTION

PATENT NO. : 6,355,141 B1
DATED : March 12, 2002
INVENTOR(S) : Sikkar et al.

It is certified that error appears in the above-identified patent and that said Letters Patent is hereby corrected as shown below:

Column 7,
Line 4, "(diallyidimethyl" should read -- (diallyldimethyl --

Signed and Sealed this

First Day of October, 2002

*Attest:*

*Attesting Officer*

JAMES E. ROGAN
*Director of the United States Patent and Trademark Office*